United States Patent [19]

Winans et al.

[11] Patent Number: 4,969,307

[45] Date of Patent: Nov. 13, 1990

[54] METHOD OF CRATING TELEPHONE SWITCHING EQUIPMENT

[75] Inventors: William O. Winans, Bridgeport, N.Y.; Robert C. Sauer, Jr., McMinnville, Tenn.

[73] Assignee: Bridgeport Crating Co., Inc., Bridgeport, N.Y.

[21] Appl. No.: 424,135

[22] Filed: Oct. 18, 1989

[51] Int. Cl.[5] ..... B65B 23/00

[52] U.S. Cl. ..... 53/399; 53/449; 53/472; 53/410

[58] Field of Search ..... 53/410, 449, 472, 399; 206/319, 320, 386, 597

[56] References Cited

U.S. PATENT DOCUMENTS 2,332,016 10/1943 Schweller ..... 206/320

2,481,855 9/1949 McKenzie ..... 206/319 X 3,209,905 10/1965 Kean, Sr. ..... 206/597

3,805,473 4/1974 Lidgard ..... 53/410 X

*Primary Examiner*—John Sipos

*Attorney, Agent, or Firm*—Charles S. McGuire

[57] ABSTRACT

A crating method wherein the bottom member of an open, metal, switching equipment frame is placed upon a horizontal, rectangular, wooden base, within an opening provided by framing members on the base, and preferably bolted thereto. A side framing assembly is then placed outwardly adjacent each side of the metal frame, the lower ends of each assembly being fixedly attached to the base and a horizontal member extending across the top of each framing assembly having an inwardly facing notch snugly receiving the adjacent side member of the metal frame. The side frame assemblies are then attached to the top member of the metal frame. The metal frame and the side framing assemblies are then enclosed in a flexible covering material.

6 Claims, 7 Drawing Sheets

METHOD OF CRATING TELEPHONE SWITCHING EQUIPMENT

BACKGROUND OF THE INVENTION

The present invention relates to methods of packing or crating telephone bay frames, relay racks, and the like, generally referred to as telephone switching equipment. More specifically, the invention relates to crating methods permitting storage and shipment of telephone switching equipment in a vertical position.

Telephone switching equipment is conventionally manufactured in the form of open, metal frames with spaced, upright members for supporting banks of relays, and the like. Such equipment may be temporarily taken out of use and placed in storage and/or shipped to another location for use there. Due to the relatively fragile nature of the equipment, and the type of crating materials used, it has been the customary practise to place the equipment on its side within the crate or package. Typical crates for such equipment have included a rectangular base with end panels hingedly connected thereto for folding movement into covering relation with the equipment lying on its side upon the base. The resulting wooden crate is covered with corrugated paperboard and banded.

Due to the weight of the equipment and the possibility of damage, the crates containing the equipment should not be stacked on top of one another. Since the height and width of the equipment are normally far greater than its depth, the space requirements are obviously much larger when the equipment is placed on its side and the crated units should not be stacked.

In spite of the added handling required, the more complicated and expensive crating with hinged side panels, and the additional space requirements, it has not previously been considered practical to crate the equipment in a vertical or upright position. This stems, at least in part, from the danger of damage to expensive equipment during handling when crated by conventional methods. Thus, there has existed a previously unfilled need for a crating system which would permit relatively safe, simple and fast packing, storing and shipping of telephone switching equipment in its normal, vertical position.

It is a principal object of the present invention to provide a method of crating telephone switching equipment including an upright metal frame holding banks of switches, relays, and similar electronic modules, in a vertical position.

A further object is to provide a novel and improved crating method for telephone switching equipment wherein the equipment and the crating materials become, in effect, an integral unit.

Another object is to provide a simplified and economical method of crating telephone switching equipment for temporary storage and/or shipment.

Other objects will in part be obvious and will in part appear hereinafter.

SUMMARY OF THE INVENTION

In accordance with the foregoing objects, the invention contemplates a crating method wherein the bottom member of an open, metal, switching equipment frame is placed upon a horizontal, rectangular, wooden base, within an opening provided by framing members on the base, and preferably bolted thereto. A side framing assembly is then placed outwardly adjacent each side of the metal frame, the lower ends of each assembly being fixedly attached to the base and a horizontal member extending across the top of each framing assembly having an inwardly facing notch snugly receiving the adjacent side member of the metal frame.

In the disclosed embodiment, a pair of flexible straps are then attached at one end of each to the top member of the metal frame to extend outwardly and downwardly over the horizontal members of the side framing assembly. The straps are stretched tautly and bolted at their other ends to outwardly facing surfaces of the horizontal members. Alternatively, a plywood cap may be nailed to the side framing assemblies and bolted to the top member of the metal frame. Depending on the width of the metal frame, intermediate framing assemblies may be attached to the base at one or more positions between the side framing assemblies. Each intermediate framing assembly includes a vertical post on the front and back sides of the equipment and a horizontal brace having a downwardly facing notch snugly receiving the metal frame top member.

A corrugated paperboard covering is then placed around the front, sides and back of the crating material and a cap, also of corrugated material, is placed on top. The unit is then banded by one or more flexible straps in the usual manner. A moisture-proof plastic covering, which may be treated with an anti-static material, if required, may be placed over the equipment to protect against the adverse effects of moisture on the electronic equipment.

The foregoing and other features and advantages of the crating method will be more readily understood and appreciated from the following detailed description, taken in conjunction wth the accompanying drawings, wherein:

DETAILED DESCRIPTION

Figure 1:
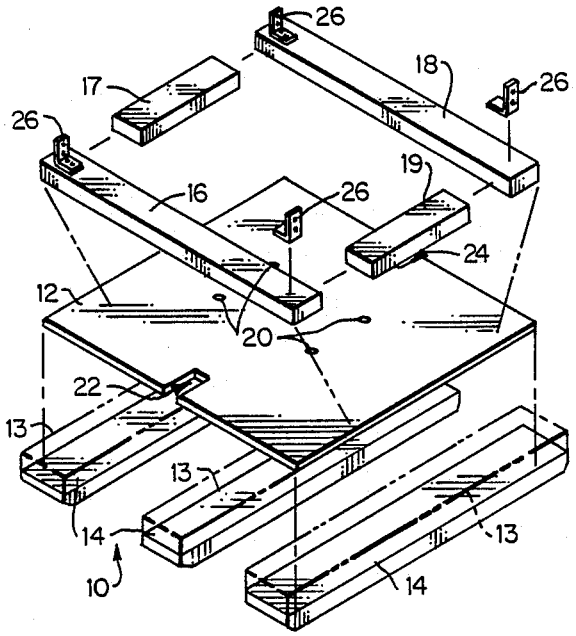
FIG. 1 is an exploded, perspective view of a first embodiment of a base assembly used in the crating method of the invention.
Figure 2:
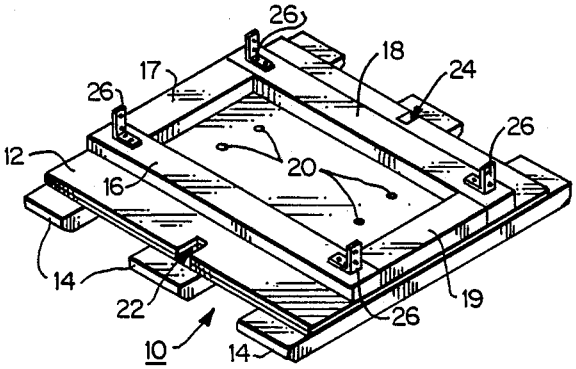
FIG. 2 is a perspective view of the base assembly of FIG. 1 in fully assembled condition.

Referring now to the drawings, in FIGS. 1 and 2 is seen, in exploded and fully assembled conditions, respectively, base assembly 10 of a type used in practising the crating method of the invention. Base assembly 10 includes a generally rectangular sheet 12 of, for example, ⅝" plywood, a plurality of skids 14 and a framing portion consisting of four boards 16–19. The skids and framing portion are affixed to the lower and upper surfaces, respectively, of sheet 12. Boards 16–19 are placed together to define a rectangular frame or opening of predetermined size. As seen in FIG. 2, the framing portion extends along both side edges of the sheet but is arranged inwardly of the front and rear edges. Four openings 20 are drilled through sheet 12 in predetermined locations, and notches 22 and 24 are formed at the center of the front and rear edges thereof. Angle irons 26 are affixed to the framing portion adjacent the four corners thereof.

Figure 3:
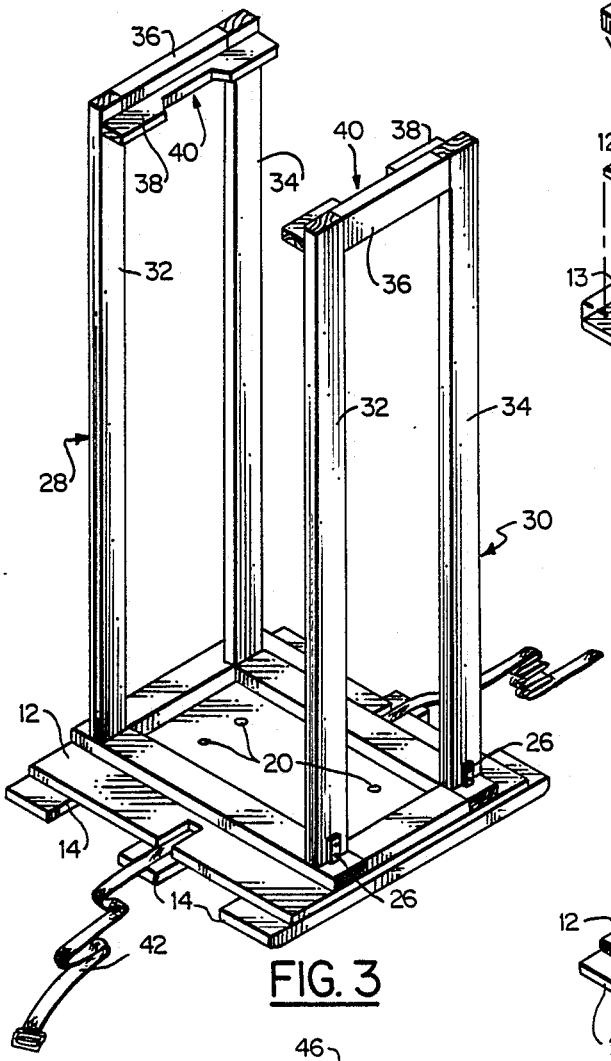
FIG. 3 is a perspective view of the base assembly with side framing assemblies erected on each end thereof.

Turning now to FIG. 3, base assembly 10 is shown with side framing assemblies, designated generally by reference numerals 28 and 30, erected at each side thereof. Each side framing assembly includes a pair of vertical posts 32 and 34, each fixedly attached at its lower end to base 10 by means of angle irons 26. The upper ends of posts 32 and 34 are joined by horizontal members 36 and 38, which may be a single, integral piece, or two initially separate pieces, as shown. Horizontal members 38 each include a centrally disposed, inwardly facing notch 40, for purposes which will be explained later. Elongated, flexible strap 42 is also shown in FIG. 3, passing under sheet 12 in registration with notches 22 and 24.

Figure 4A:
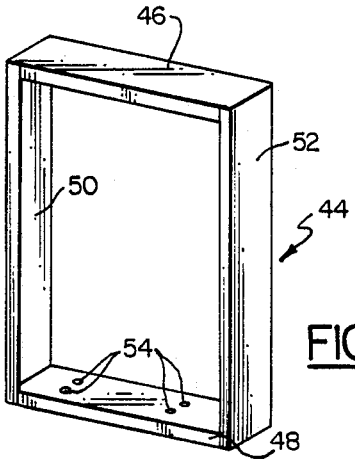
FIG. 4*a* is a somewhat diagrammatic, perspective view of a metal frame member of the switching equipment unit of FIG. 4.

In FIG. 4*a* is shown a conventional, single frame, metal support structure of a type commonly used in telephone switching equipment and known as bay frames or relay racks. The open, metal frame, denoted generally by reference numeral 44, includes top and bottom members 46 and 48, respectively, and side members 50 and 52, rigidly attached at adjacent ends. Four openings 54 in bottom member 52 are positioned for registration with openings 20 when frame 44 is positioned upon sheet 12 with bottom member 52 positioned in the rectangular opening provided by boards 16–19 which is of approximately the same length and width as the bottom frame member.

As a step in the packaging method of the invention, frame 44 is positioned on base assembly 10, with bottom member 52 received in the opening formed by the framing portion, and bolts are inserted through the aligned sets of openings 20 and 54, thereby fixedly attaching the metal frame to the crating base. In some cases, it may not be necessary to affix the frame to the base with bolts since, as explained later, the metal frame is otherwise affixed to the crating members. Although side framing assemblies 28 and 30 are shown in FIG. 3 as affixed to base assembly 10 prior to placement of metal frame 44 on the base, for greater clarity of illustration, it is preferred that the frame be positioned on and attached to the base prior to erecting and attaching the side framing assemblies to the base. Notches 40 are positioned and dimensioned to receive snugly the upper portions of frame side members 50 and 52.

Figure 4:
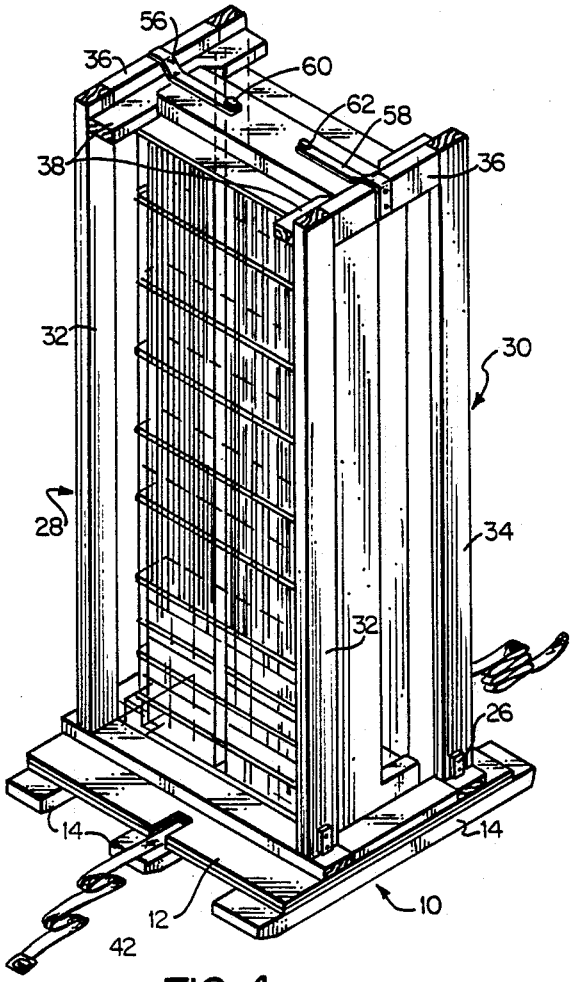
FIG. 4 is a perspective view of the crating assembly including a telephone switching equipment unit supported therein.

Frame 44 is shown in FIG. 4 positioned upon and attached to base assembly 10, with banks of relays or other such electronic equipment supported in the usual manner in the frame. The loading of such equipment into frame 44 may be done either before or after the frame is affixed to the base, although this has no bearing on the present invention. After side frame assemblies 28 and 30 are positioned outwardly adjcent opposite sides of frame 44, flexible straps 56 and 58 are fixedly attached adjacent one end of each to top frame member 46 by bolts 60 and 62, respectively, extending through aligned openings in the straps and top member. Straps 56 and 58 are extended outwardly and downwardly, and affixed at their opposite ends to upper and/or outer surfaces of horizontal members 36 of the side framing assemblies. Although the use of straps 56 and 58 in the manner described is preferred, other means may be used to secure the upper part of metal frame 44 to the crating assembly; for example, a plywood cap may be placed over top member 46 of the frame, nailed to horizontal members 38 and bolted to top frame member 46.

Figure 5:
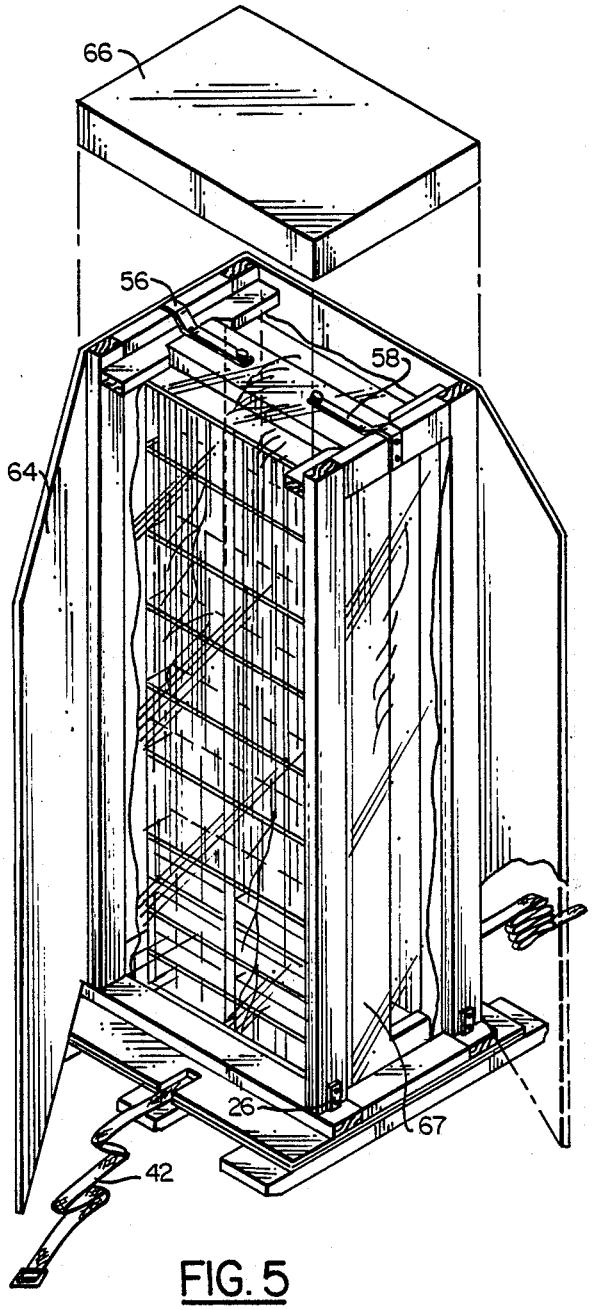
FIG. 5 is a perspective view of the crating assembly of FIG. 4 with the switching equipment enclosed in a protective bag and a cardboard covering partly surrounding the assembly.
Figure 6:
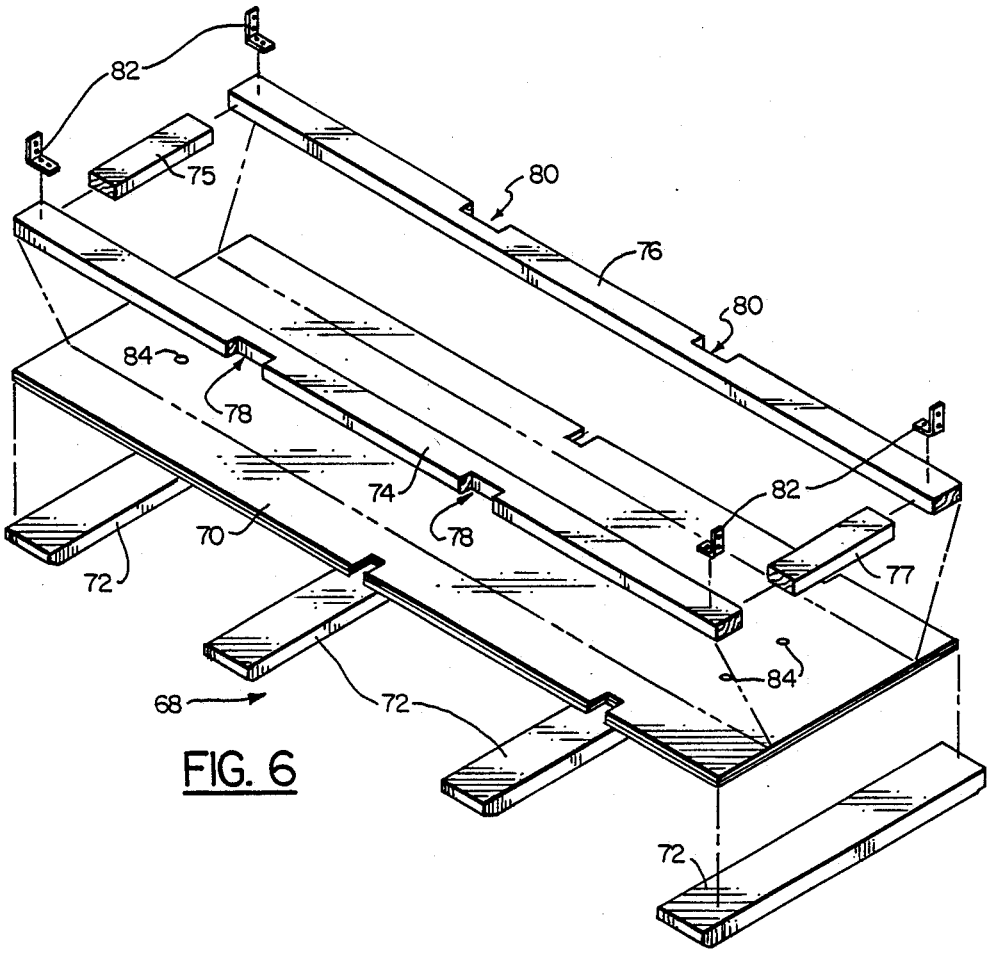
FIG. 6 is an exploded, perspective view of a second embodiment of the base assembly.
Figure 7:
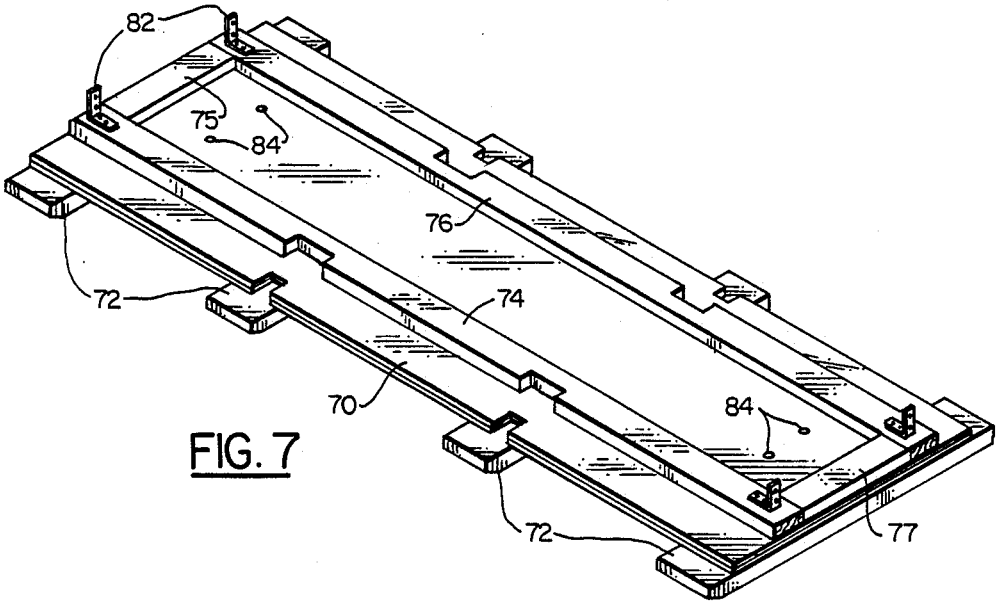
FIG. 7 is a perspective view of the base assembly of FIG. 6 in fully assembled condition.

After completion of the steps described above, a corrugated paperboard covering is placed around the crating system, including the integrally attached metal frame of the switching equipment, as shown in FIG. 5. The covering includes a lower section 64 which wraps around the front, back and both sides, and a top section or cap 66, thereby enclosing everything above base assembly 10. Lower section 64 has a length greater than the circumference of the portion of the crating system which it covers, leaving an overlapping flap of several inches for attachment of the lower section of the corrugated covering to itself by adhesive, stapling, etc. Cap 66 has a depending skirt dimensioned to fit snugly over the top of the lower section. In applications where the switching equipment must be protected against the adverse effects of moisture on relay contacts and other components of the electronic equipment, a moisture-proof bag of ployethylene, or the like, such as that indicated in FIG. 5 by reference numeral 67 may be placed over the equipment. If required, bag 67 may be coated or otherwise treated with a conventional, anti-static material. Bags of conventional, moisture-absorbing dessicant may be placed inside bag 67.

Turning now to FIGS. 6–10, the crating method will be described in relation to a multi-frame unit of switching equipment. The method again begins with construction of a base assembly such as that shown in FIGS. 6 and 7 and denoted generally by reference numeral 68. Base assembly 68 includes rectangular sheet 70, a plurality of skids 72 and a framing section formed by boards 74–77 affixed to the upper surface of sheet 70 to define a rectangular opening having a length and width corresponding substantially to that of the bottom member of a metal frame for the telephone switching equipment to be crated. It will be noted that notches 78 and 80 are formed in the outer edges of boards 74 and 76, respectively, in the present embodiment. Angle irons 82 are affixed to the framing portion inwardly adjacent the four corners thereof. Holes 84 are formed at predetermined locations in sheet 70.

Figure 8:
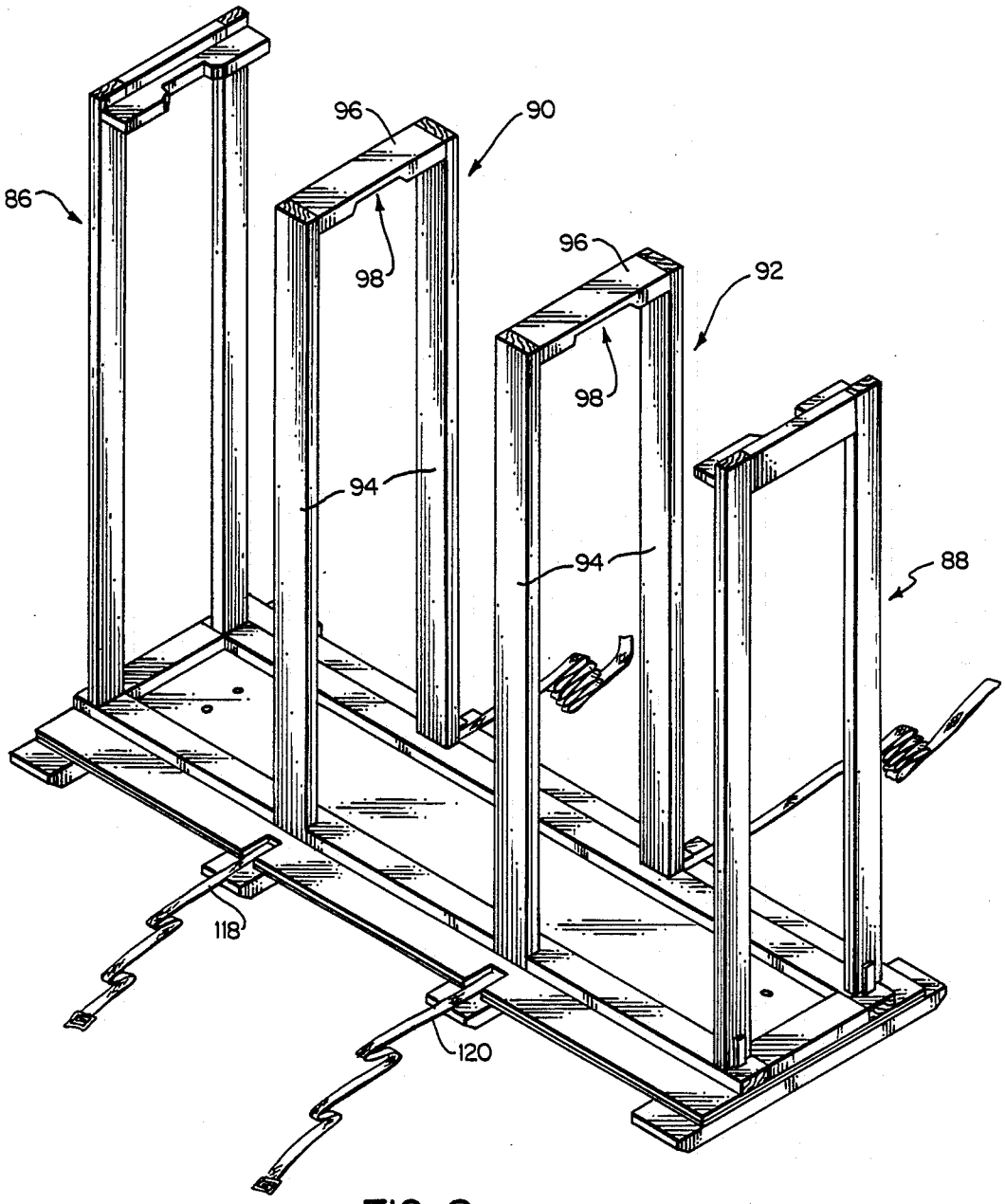
FIG. 8 is a perspective view of the base assembly of FIG. 7 with intermediate and side framing members erected thereon.
Figure 9:
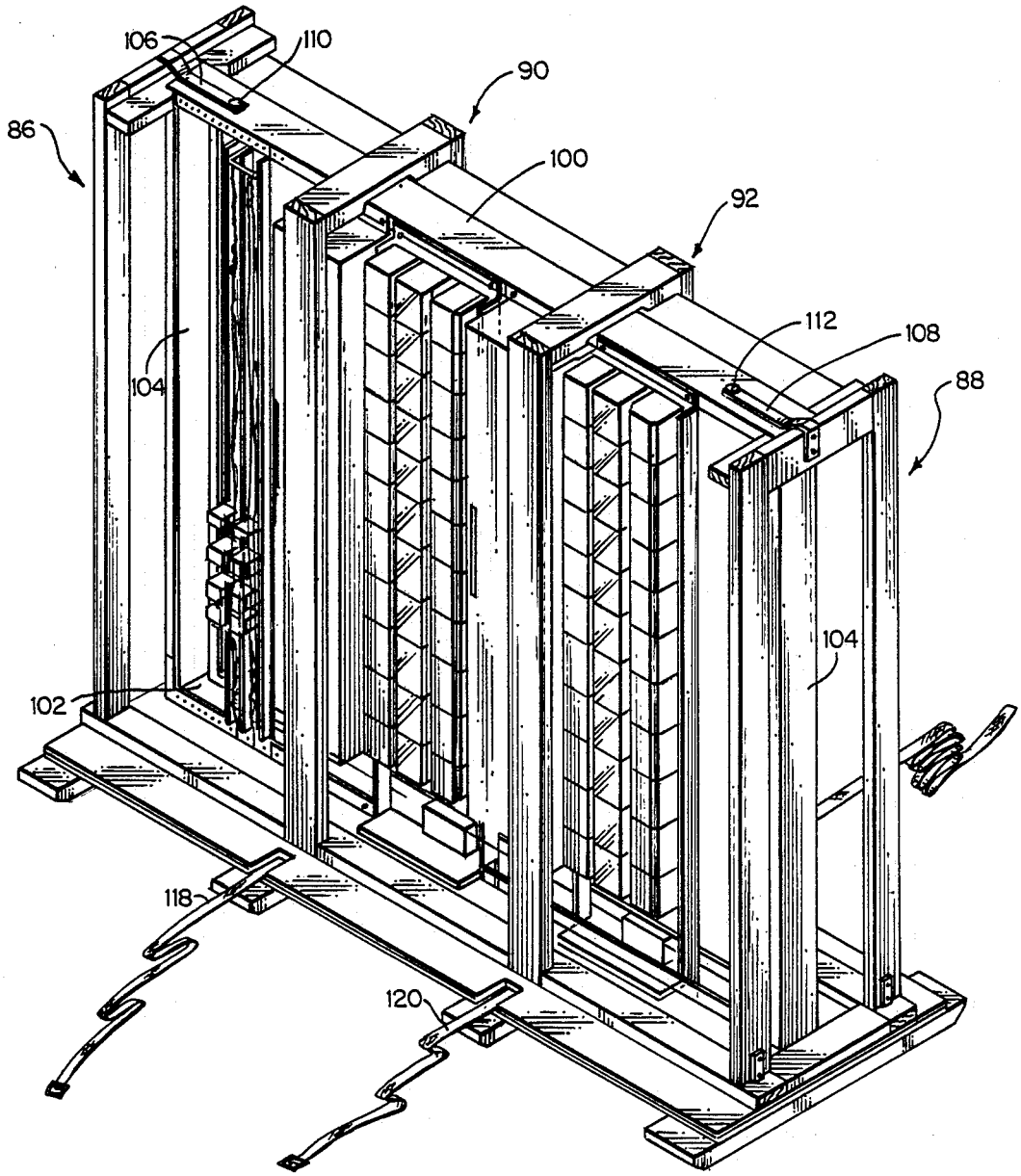
FIG. 9 is a perspective view of the crating assembly of FIG. 8 including a multi-bay telephone switching equipment unit supported therein.

The crating system is shown in FIG. 8 with upper portions attached to base assembly 68, and without the switching equipment in place, although it will be understood that at least the metal frame of the switching equipment is placed upon and attached to the base assembly prior to placement and attachment of the upper portions. Such upper portions include side framing assemblies 86 and 88, which may be essentially identical to side framing assemblies 28 and 30, and intermediate framing assemblies 90 and 92, each having a pair of vertical posts 94 and horizontal member 96. The lower ends of posts 94 are placed in notches 78 and 80 and nailed to boards 74 and 76. The upper ends of posts 94 are connected by horizontal members 96, each of which includes downwardly facing notch 98.

The switching equipment of the embodiment of FIGS. 6–10 also includes an open, metal frame having top, bottom and side members, differing from that of FIG. 4*a* only in that it includes multiple, side-by-side bays for holding the electronic equipment. The metal frame top and bottom members are indicated by reference numerals 100 and 102, respectively, and the two side members by reference numeral 104, in FIGS. 9 and 10. Bottom member 102 includes four holes which are in registration with holes 84 in sheet 70 when the metal frame is placed within the opening formed by boards 74–77.

Bottom member 102 is bolted to the base assembly, and the side and intermediate framing assemblies are then positioned and attached to the base assembly at their lower ends. The inwardly facing notches in the horizontal members of side framing assemblies 86 and 88 embrace the upper portions of frame side members 104, and downwardly facing notches 98 of intermediate framing assemblies 90 and 92 embrace top member 100. Straps 106 and 108 are attached adjacent one end of each by bolts 110 and 112 to top member 100, and extend over portions of the horizontal members of side framing assemblies 86 and 88 for attachment thereto, thus making the frame of the switching equipment and the wooden framing members of the crating system an essentially integral unit.

Figure 10:
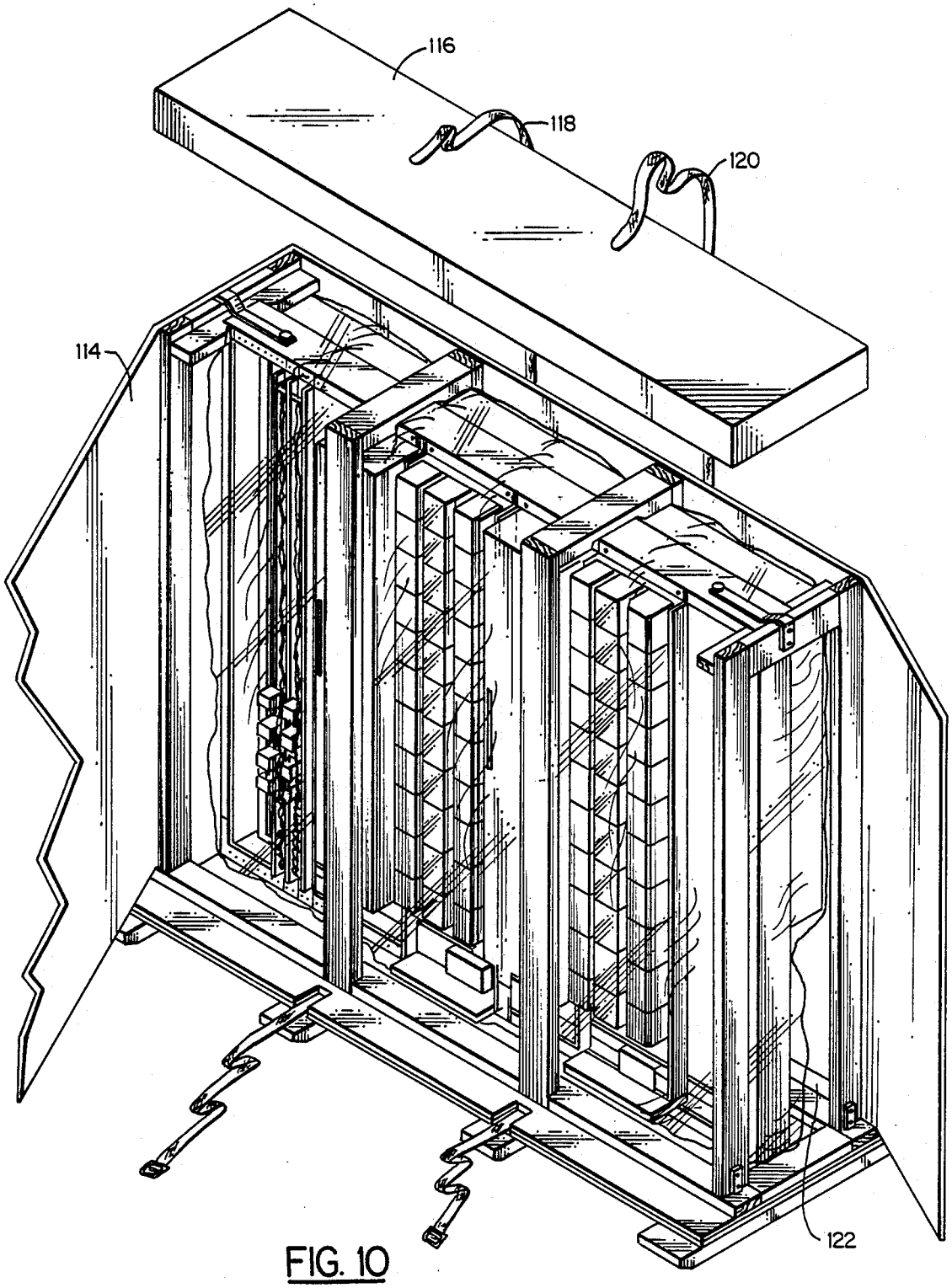
FIG. 10 is a perspective view of the crating assembly of FIG. 9 with the switching equipment enclosed in a protective bay and a cardboard casing partly covering the assembly.
Figure 11:
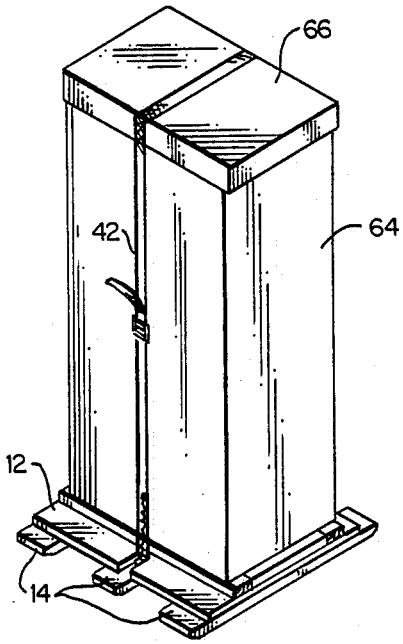
FIGS. 11 and 12 are perspective views of the embodiments of FIGS. 1–5 and 6–10, respectively, in their final, fully packaged conditions.
Figure 12:
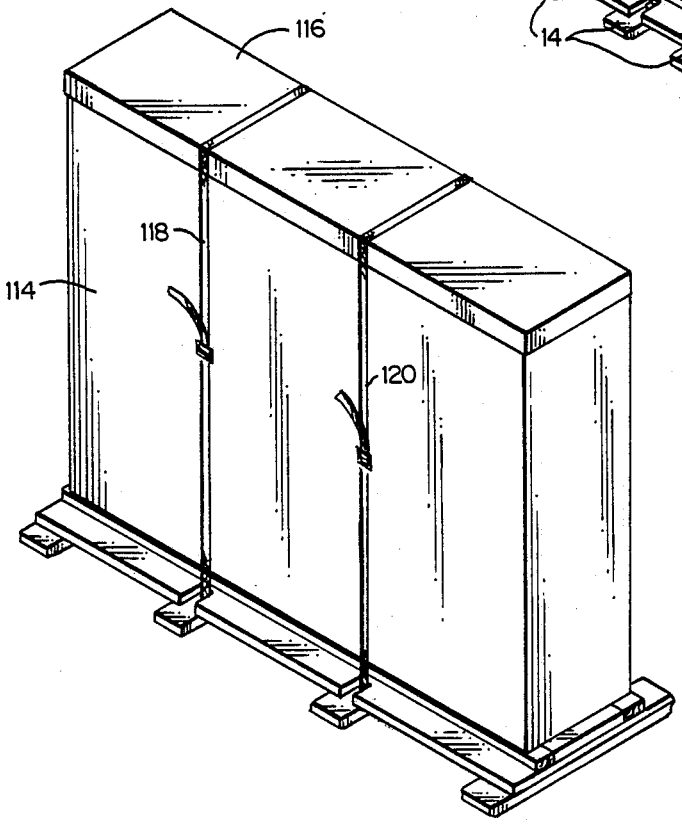

A corrugated paperboard covering, consisting of lower portion 114 and cap 116, is then placed over the equipment and upper portions of the wooden framing and secured by flexible straps 118 and 120, as in the previously described embodiment. Again, the switching equipment may be enclosed, within the wooden framing and corrugated covering, within moisture-proof bag 122, as shown in FIG. 10. The fully-crated single and multiple-frame units are shown in FIGS. 11 and 12, respectively. If desired, rigid, low density plastic foam may be positioned between the base and skids of the base assembly, such as that shown in phantom lines and indicated by reference numeral 13 in FIG. 1, and/or between the horizontal members of the side and intermediate frame assemblies for shock protection. Crating of conventional switching equipment according to the method of the present invention has been found to effect a labor savings of approximately one man-hour per frame crated over the prior system which required the frames to be tipped on one side and placed on the horizontal base or pallet. Also, the cost of the crating materials is less since the present method does not require the adjustable braces and hinged end panels associated with conventional telephone switching equipment crating materials. The most significant advantage in many cases is the space saving effected by crating the equipment in a manner permitting storage and shipment in the upright position, whereby typically three units can be placed in the same floor space occupied by one horizontally crated unit of the same size. Furthermore, the present crating method may in many cases avoid damage to the relatively fragile electronic equipment by eliminating the necessity of tipping it to rest on one of its sides.

What is claimed is:

1. A method of crating for storage or shipment telephone switching equipment of the type having an open metal frame including top, bottom and side members with one or more banks of electronic equipment supported therein, said method comprising:

(a) constructing a wooden base assembly comprising:
  (i) a rectangular sheet having upper and lower surfaces and a length and width appreciably greater than the length and width of said metal frame bottom member;
  (ii) a plurality of skids affixed to said lower surface in spaced, parallel relation; and
  (iii) a framing portion affixed to said upper surface and defining a rectangular opening having a length and width substantially equal to the length and width of said metal frame bottom member;

(b) placing said switching equipment upon said base with said metal frame bottom member resting upon said upper surface of said sheet and said framing portion surrounding said metal frame bottom member;

(c) fixedly attaching a pair of side framing assemblies at lower ends of each to said base assembly outwardly adjacent said metal frame side members, said side framing assemblies each comprising two, spaced, vertical members having upper ends joined by a horizontal member having an inwardly facing notch embracing the adjacent metal frame side member, said side framing assemblies upper ends being in a vertical plane above said metal frame top member;

(d) fixedly attaching said side framing assemblies to said metal frame top member; and (e) enclosing said switching equipment and side framing assemblies on the front, back, sides and top in a flexible covering of corrugated paperboard material, or the like.

2. The method of claim 1 wherein said covering material comprises a first portion extending around said front, back and sides and attached to itself, and a second portion forming a cap extending over said top of said switching equipment and side framing assemblies, and having a skirt portion extending downwardly over the upper edges of said first portion.

3. The method of claim 2 and further including passing at least one flexible loop of banding material tautly around at least a portion of said base assembly and the front, back and top of said covering material, and affixing said loop to itself.

4. The method of claim 1 and further comprising the step of fixedly attaching to said base assembly at least one intermediate framing assembly having a pair of vertical posts positioned between said side framing assemblies on the front and back of said switching equipment, and a horizontal brace extending between and fixedly attached to the upper ends of said posts and having a downwardly facing notch embracing said metal frame top member.

5. The method of claim 1 and further comprising the step of bolting said metal frame bottom member to said rectangualr sheet.

6. The method of claim 1 wherein said side framing assemblies are fixedly attached to said metal frame top member by:

(a) fixedly attaching one end of each of a pair of straps to an upper surface of said metal frame top member;

(b) extending said straps from said one end of each outwardly over respective ones of said side framing assemblies horizontal members;

(c) fixedly attaching the other end of each of said straps to said respective ones of said horizontal members.

* * * * *